US007159276B2

(12) United States Patent
Omoto et al.

(10) Patent No.: US 7,159,276 B2
(45) Date of Patent: Jan. 9, 2007

(54) ROTARY CLEANING BODY, SUCTION PORT BODY OF VACUUM CLEANER, AND PRODUCTION METHOD OF ROTARY CLEANING BODY

(75) Inventors: Shuhei Omoto, Kanagawa (JP); Yasuhiro Ohtsu, Kanagawa (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/134,591

(22) Filed: May 18, 2005

(65) Prior Publication Data

US 2005/0246857 A1 Nov. 10, 2005

Related U.S. Application Data

(63) Continuation of application No. PCT/JP03/14894, filed on Nov. 21, 2003.

(30) Foreign Application Priority Data

Nov. 22, 2002 (JP) ..... 2002-340017

(51) Int. Cl.
*A47L 9/04* (2006.01)
*A46B 9/08* (2006.01)

(52) U.S. Cl. ..... 15/383; 15/366; 15/141.2; 15/183

(58) Field of Classification Search ..... 15/383, 15/183, 366, 141.2, 5, 179, 182
See application file for complete search history.

(56) References Cited

U.S. PATENT DOCUMENTS 848,974 A * 4/1907 Crossman ..... 15/383
2,285,375 A * 6/1942 Hansen ..... 15/182
2,734,211 A * 2/1956 Vance ..... 15/183
3,225,374 A * 12/1965 Daley et al. ..... 15/183
3,241,172 A * 3/1966 Tilgner ..... 15/183
3,533,125 A * 10/1970 White et al. ..... 15/183
4,238,870 A * 12/1980 Fahlen ..... 15/183

FOREIGN PATENT DOCUMENTS

JP 06-007271 * 1/1994
JP 6-85752 B2 11/1994
JP 6-327593 A 11/1994
JP 09-154783 * 6/1997
JP 9-154783 A 6/1997
JP 11-155780 A 6/1999
JP 2003-000484 A 1/2003

* cited by examiner

*Primary Examiner*—Theresa T. Snider
(74) *Attorney, Agent, or Firm*—Frishauf, Holtz, Goodman & Chick, P.C.

(57) ABSTRACT

Catching grooves (34) extending in the axial direction are formed in the cylindrical outer surface of a brush base (35) that has a slender, substantially cylindrical shape and made of a twistable material. Brush attaching portions (43) of brush members (41) and blade attaching portions (47) of scraping members (42) are respectively secured in the catching grooves (34) so that axially aligned bristles (44) of each brush member (41) and an axially extending blade (46) of each scraping member (42) project from the cylindrical outer surface of the brush base (35). Receiving members (53) are respectively fitted to both ends of a shaft (51) inserted through a shaft insertion hole (39) of the brush base (35). By rotating the receiving members (53) in opposite directions, the brush base (35) is twisted in a spiral and secured. By eliminating the necessity of forming the brush base (35) in a twisted shape beforehand by means of twist extrusion molding, the invention facilitates production of the brush base (35). Adjusting the degree of twisting the brush base (35) ensures a sufficient twisting precision.

4 Claims, 7 Drawing Sheets

ROTARY CLEANING BODY, SUCTION PORT BODY OF VACUUM CLEANER, AND PRODUCTION METHOD OF ROTARY CLEANING BODY

This application is a Continuation Application of International Application No. PCT/JP2003/014894 filed Nov. 21, 2003, which claims the priority of Japanese Application No. 2002-340017 filed Nov. 22, 2002.

TECHNICAL FIELD

The present invention relates to a rotary cleaning body, a suction port body of a vacuum cleaner equipped with the rotary cleaning body, and a production method of the rotary cleaning body, wherein cleaning members that extend in a spiral along the axial direction and protrude outward are attached to the cylindrical outer surface of an axial member of the rotary cleaning body.

BACKGROUND ART

One of conventionally known examples of rotary cleaning bodies of this type is disclosed in Japanese Examined Patent Publication No. 6-85752. The rotary cleaning body described in Japanese Examined Patent Publication No. 6-85752 is provided with a shaft that is in a slender, cylindrical shape having a plurality of catching grooves formed in the cylindrical outer surface of the shaft and serving as receiving grooves. Each catching groove has a recessed cross section and spirally extends in the axial direction of the shaft. The catching grooves of the shaft are axially provided at regular intervals in the circumferential direction on the outside periphery. The shaft is formed of aluminum by twist extrusion molding so that the catching grooves are spirally formed.

The base end of a long, narrow blade, which has a triangular cross section and serves as a cleaning member, is securely fitted in each catching groove so that each blade spirally extends along the cylindrical outer surface of the shaft and rises like a wall therefrom.

A pin insertion hole extending the axial direction of the shaft is formed through the center of the shaft so as to form an opening at both axial ends of the shaft. A pin that is an axial member in the shape of a slender, long bar is pushed through the pin insertion hole and thereby integrally attached to the shaft so that the two ends of the pin respectively project from the two axial end faces of the shaft.

The shaft of the rotary cleaning body described above is formed of aluminum by twist extrusion molding in order to form the catching grooves in such a shape as to be spirally wound around the shaft. This feature presents a problem in that it is prone to distortion and therefore difficult to ensure sufficient precision, often resulting in uneven rotation when the shaft is rotated.

In order to solve the above problems, an object of the invention is to provide a rotary cleaning body that can be formed with precision easily, a suction port body of a vacuum cleaner equipped with this rotary cleaning body, and a method of producing this rotary cleaning body.

DISCLOSURE OF THE INVENTION

The present invention calls for securing the base ends of cleaning members in recess-shaped, axially extending receiving grooves that are formed in the cylindrical outer surface of a mounting member having a cylindrical shape, thereby attaching the cleaning members to the mounting member so that the cleaning members extend along the axial direction and protrude outward in the radial direction of the mounting member, and, subsequently, inserting an axial member through the center of the mounting member and attaching the mounting member to the axial member so that each receiving groove is shaped into a spiral. As the formation process of the axial member does not involve twisting of the axial member, a sufficient precision of the axial member is ensured. Therefore, when the rotary cleaning body is rotated, uneven rotation is prevented.

BEST MODE FOR CARRYING OUT THE INVENTION

Next, the structure of a vacuum cleaner according to another embodiment of the present invention is explained hereunder, referring to relevant drawings.

Figure 7:
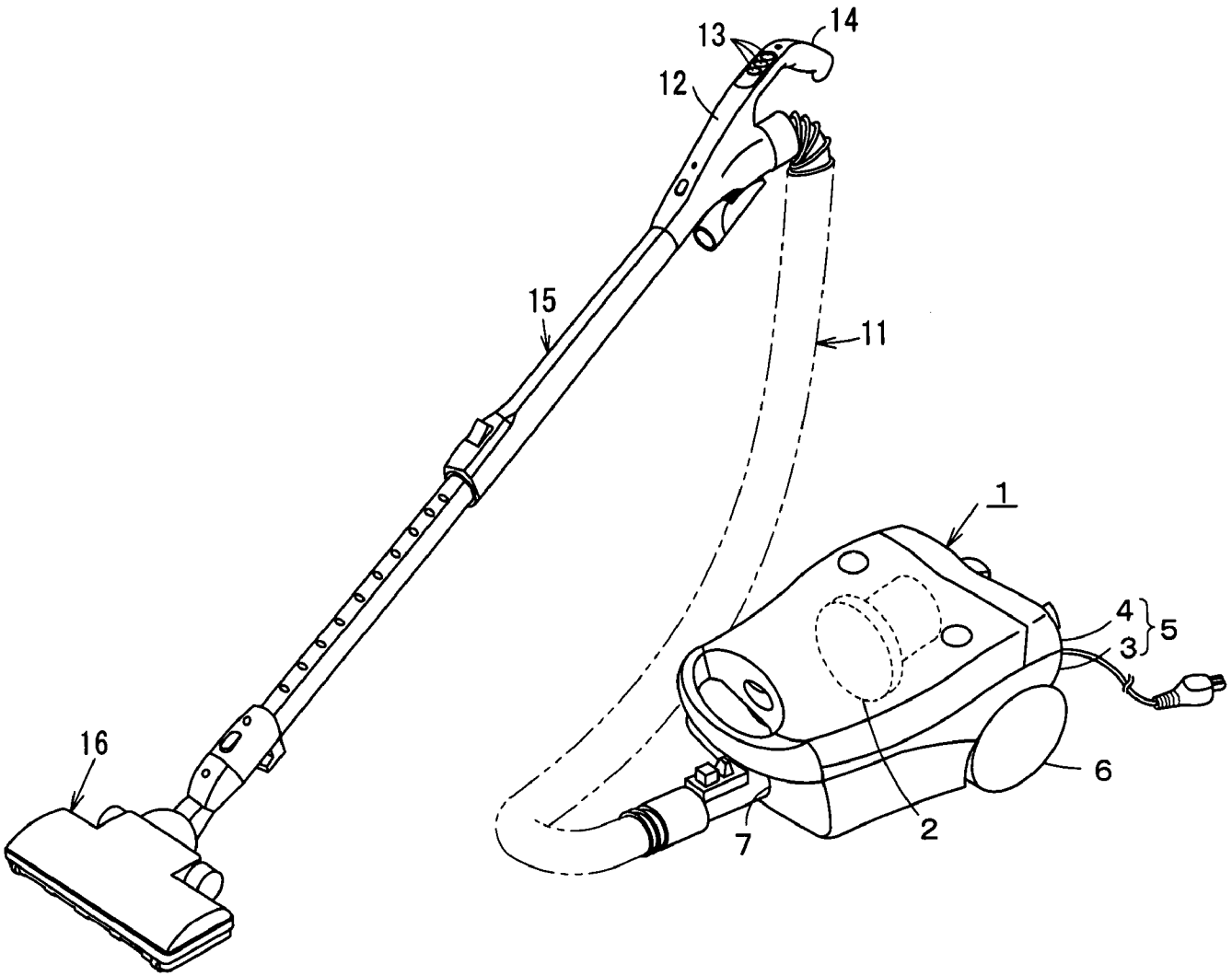
FIG. 7 is a perspective of a vacuum cleaner that is provided with the suction port body.

Referring to FIG. 7, numeral 1 denotes the main body of the cleaner. The cleaner main body 1 incorporates a motor fan 2. The cleaner is an electric vacuum cleaner that is adapted to suction up dust together with suction air generated by driving the motor fan 2 and collect the suctioned dust into a dust collection pack (not shown).

The cleaner main body 1 has a lower casing 3, which is made of synthetic resin and open at the top. Provided on top of the lower casing 3 is an upper casing 4 provided with an open/close cover that is made of synthetic resin and serves to open or close a part of the top of the lower casing 3. The lower casing 3 and the upper casing 4 together constitute a main body casing 5, which serves as the casing referred to, for example, the Summary of the Invention.

A rotating wheel (not shown) is rotatably and pivotably attached to the underside of the main body casing 5, near the front end thereof. A following back wheel 6 having a greater diameter is rotatably attached to each lateral side of the main body casing 5, near the rear end thereof. The rotating wheel and the following back wheels 6 thus enable the main body casing 5 to travel on a floor, which is a surface to be cleaned.

A cleaner main body suction port 7 for suctioning up the air from the outside is open at the approximate center of the front side of the main body casing 5. A hose assembly 11, which is a long, slender flexible cylindrical tube and serves as a connecting tube, is communicatively connected to the cleaner main body suction port 7. A hand control unit 12 for enabling selection of operation modes of the motor fan 2 is provided at the distal end of the hose assembly 11. The hand control unit 12 is provided with a plurality of selection buttons 13 for setting the driving mode of the motor fan 2 incorporated in the cleaner main body 1 or other functions in a desired mode. A handle portion 14 is projected from the base end of the hand control unit 12 so as to enable an operator to hold it when performing cleaning.

A stretchable extension pipe 15 having a slender, substantially cylindrical shape is removably attached to the hand control unit 12. A floor brush 16 is removably attached to the distal end of the extension pipe 15 so as to communicate therewith and serves as a suction port body, which may be placed on, for example, a carpet on an indoor floor and suction up dust.

Figure 1:
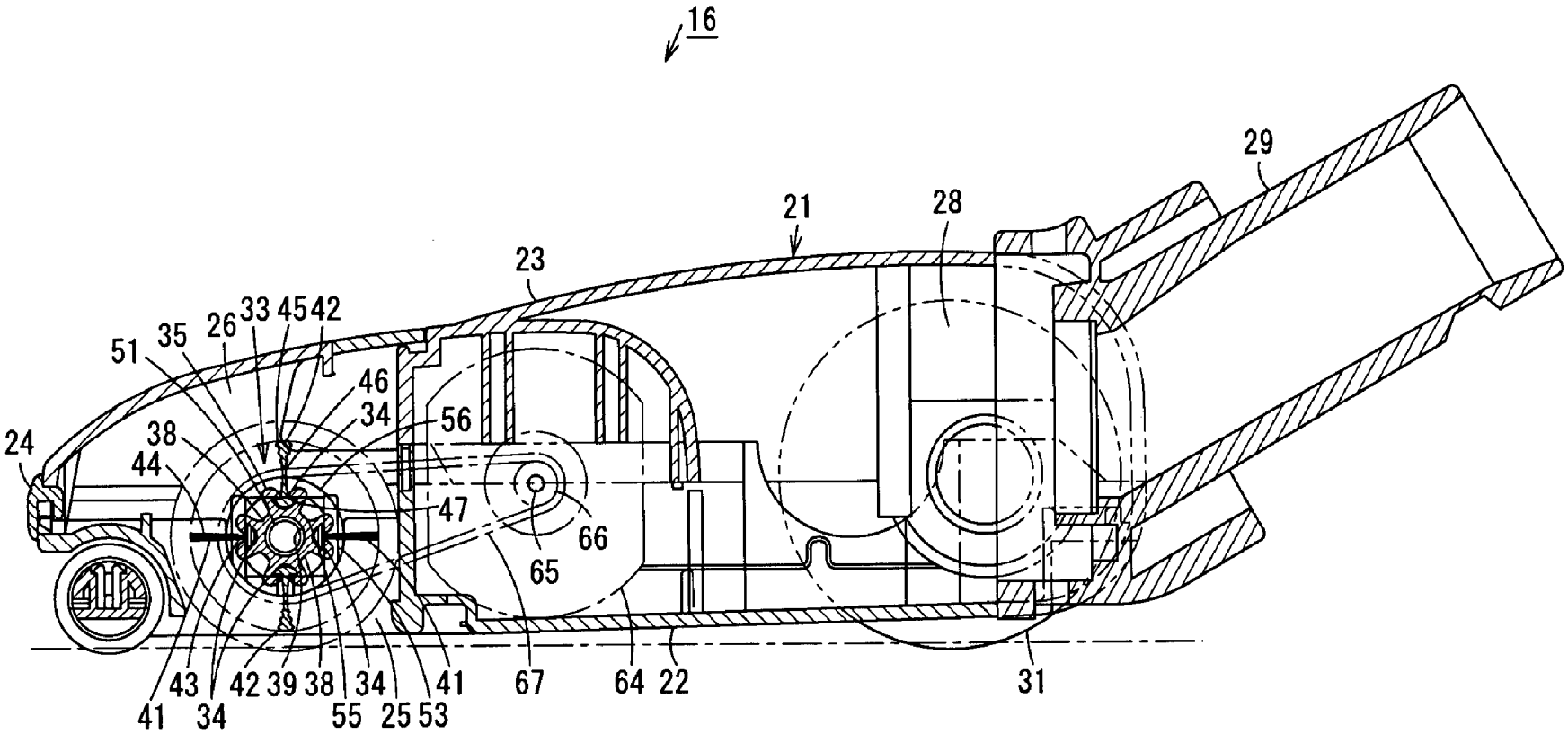
FIG. 1 is a vertical sectional view of a suction port body of a vacuum cleaner according to an embodiment of the present invention.
Figure 2:
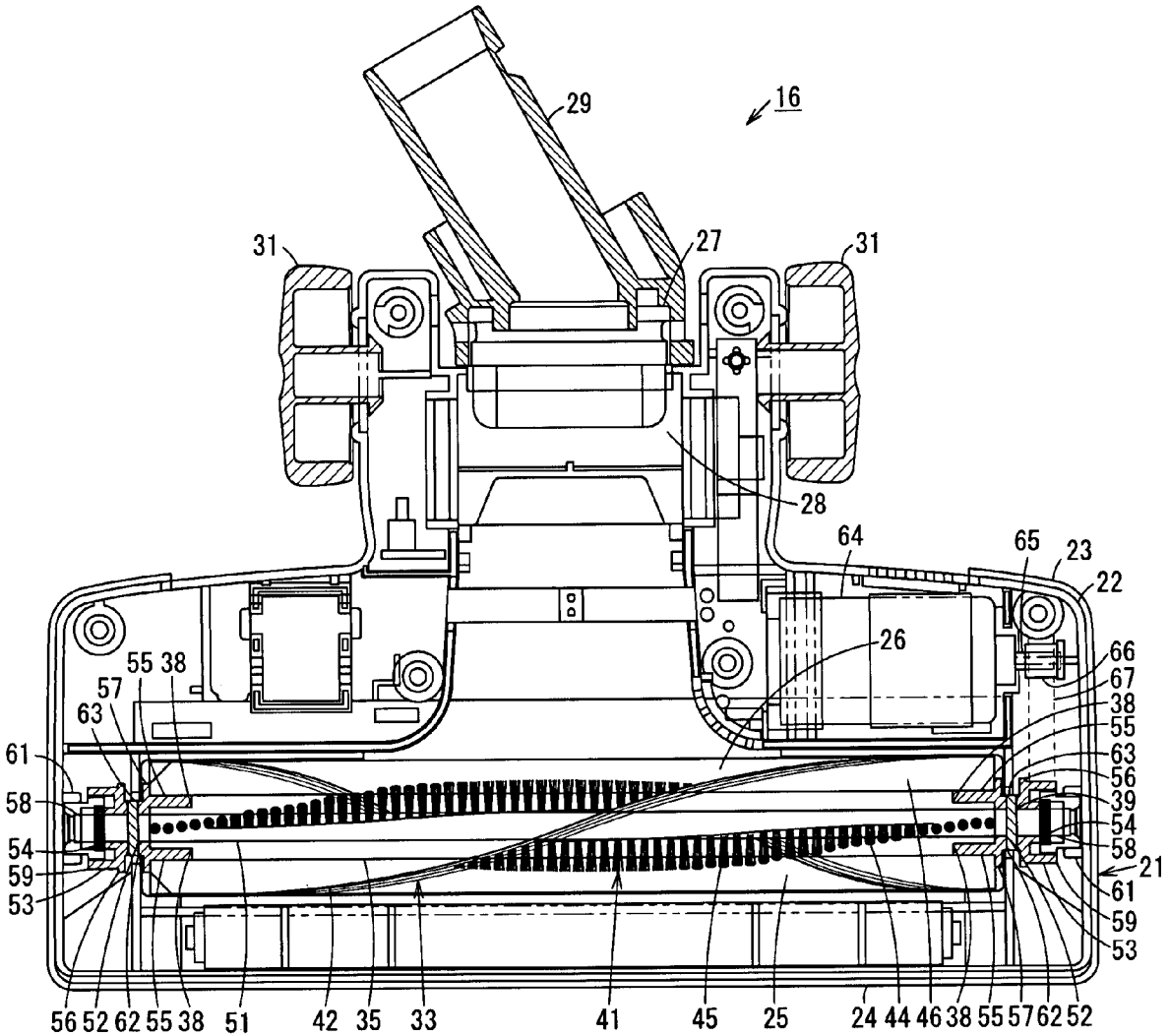
FIG. 2 is a horizontal sectional view of the aforementioned suction port body.

As shown in FIGS. 1, 2, and 7, the floor brush 16 has a truncated T-shaped casing 21, which is longer sideways than in the forward-backward traveling direction, with the approximate center portion of the rear end projecting rearward. The casing 21 is comprised of a lower casing 22 open at the top, an upper casing 23 placed on the lower casing 22 so as to cover the opening at the top of the lower casing 22, and a bumper 24 made of a flexible material and serving as a buffer. The lower casing 22 has an upper part that is made of synthetic resin and has the aforementioned opening at the top. The upper casing 23 has a lower part that is open at the bottom and made of the same material as that of the upper part of the lower casing 22. The upper casing 23 and the lower casing 22 are securely attached to each other in such a state as to sandwich the bumper 24, which extends along the peripheral edge of the upper casing 23 and the lower casing 22, including the front end thereof.

The lower casing 22 of the casing 21 has a narrow, rectangular suction opening 25, which is formed at the bottom of the lower casing 22 facing a surface to be cleaned, e.g. a floor surface. The suction opening 25 is formed in a rectangular shape that is longer sideways than in the traveling direction of the casing 21 and located to the front end of the casing 21.

The interior of the casing 21 is sectioned so that the section above the suction opening 25 forms an air intake chamber 26 that communicates with the suction opening 25. A section located further to the rear of the air intake chamber 26 forms an air path chamber 28. The air path chamber 28 communicates with a communicating port 27, which is open at the approximate center of the rear end of the casing 21. The air path chamber 28 also communicates with the space behind the air intake chamber 26. A circumferentially rotatable communicating pipe 29 in the shape of a bent cylinder is communicatively connected to the communicating port 27 of the casing 21, in such a manner as to be removably attached to the distal end of the aforementioned extension pipe 15 so that the communicating pipe 29 communicates with the extension pipe 15.

A pair of following back wheels 31 are respective attached to the two lateral sides of the rear portion of the casing 21. These following back wheels 31 are capable of rotating in the forward-backward traveling direction, enabling the floor brush 16 to travel.

Figure 3:
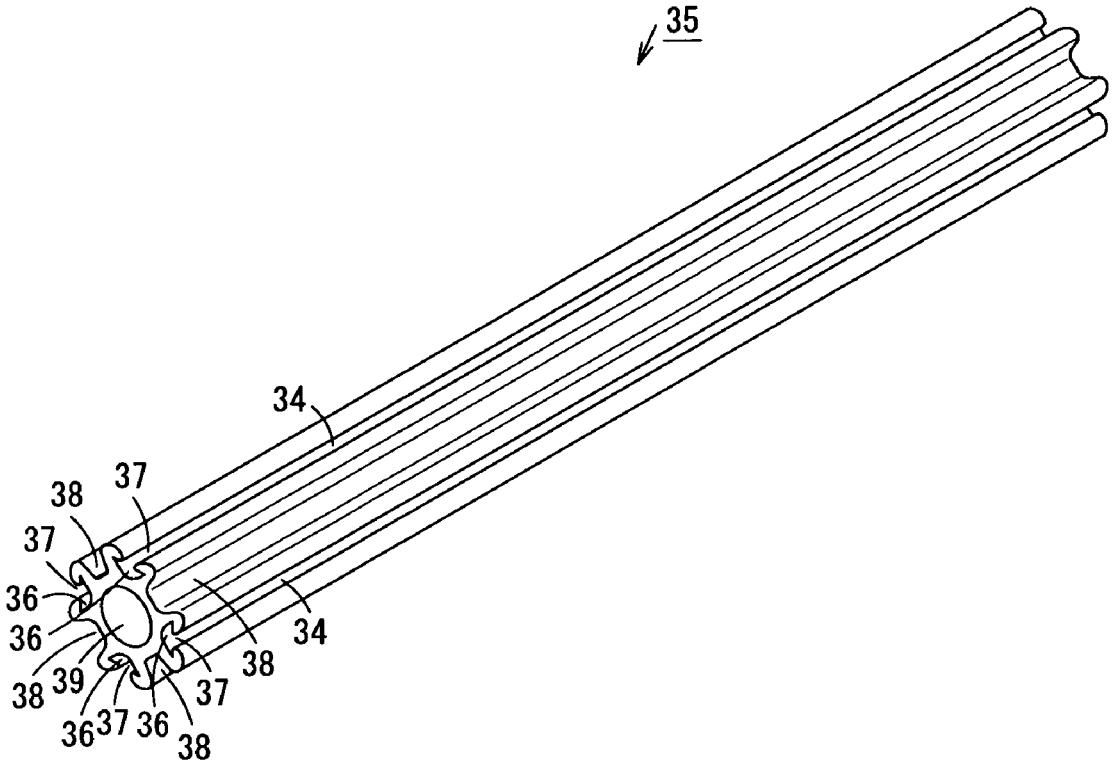
FIG. 3 is a perspective of a mounting member of a rotary cleaning body of the suction port body.

A slender, substantially cylindrical rotary brush 33 that serves as a rotary cleaning body is disposed inside the air intake chamber 26 of the casing 21. The rotary brush 33 is supported by a shaft so as to be capable of smoothly rotating in the traveling direction of the floor brush 16. The rotary brush 33 is provided with a slender, substantially cylindrical brush base 35, which serves as a mounting member for the rotary brush 33. As shown in FIGS. 1 through 3, the brush base 35 is provided with a plurality of catching grooves 34 having a recessed cross section. The catching grooves 34 are formed in the cylindrical outer surface of the brush base 35 so as to extend in the axial direction of the brush base 35. In the case of the present embodiment, four catching grooves 34 are provided. The catching grooves 34 serve as receiving grooves referred to, for example, the Summary of the Invention.

The catching grooves 34 of the brush base 35 are circumferentially spaced apart at regular intervals and extend straight in the axial direction of the brush base 35. The brush base 35 may be formed by extrusion molding of a rigid material that can be deformed, in other words a material that is sufficiently flexible to permit twisting, such as plastic or polyethylene. By applying heat shock to the brush base 35 when the brush base 35 is circumferentially twisted in a spiral, in other words heating the brush base 35 so as to increase the temperature by, for example, more than 30° C. and subsequently cooling the brush base 35, the twisted state is maintained to a certain extent.

As shown in FIGS. 1 through 3, each catching groove 34 of the brush base 35 is comprised of a flaring portion 36 and a communicating portion 37. The flaring portion 36 forms the inner portion of the catching groove 34 and has a wider cross section. The communicating portion 37 is narrower than the flaring portion 36 and links the flaring portion 36 with the outer surface of the brush base 35. Thus, the cross section of the brush base 35 is in the shape of a recess having a narrow opening, with its opening portion indented like a step. The flaring portion 36 of each catching groove 34 has a base end that is formed in an inwardly curved arc when viewed in a cross section, and an outer end whose inner edge is a flat surface that faces toward the base end.

An axially extending stopper groove 38 having a recessed cross section is formed between each catching groove 34 and its adjacent catching groove 34. Each stopper groove 38 gradually flares from the base end, i.e. the inner end, towards the circumferential outer end.

Brush members 41 and scraping members 42 comprise cleaning members. The brush members 41 and the scraping members 42 are alternately arranged around the brush base 35, with their base ends secured in the catching grooves 34. The brush members 41 and the scraping members 42 are attached to the brush base 35 in such a manner that each one of the members extends in the axial direction of the brush base 35 and rises like a wall from the cylindrical outer surface of the brush base 35.

Each brush member 41 includes a brush attaching portion 43 formed in the shape of a narrow, rectangular plate that can be removably fitted in a catching groove 34. Each brush attaching portion 43 is formed of flexible vinyl chloride or the like in a shape having a cross section similar to that of each catching groove 34 of the brush base 35. Bundles of bristles 44 are arranged along the length of each brush attaching portion 43 and embedded in its outer surface so that the bristles 44 project like a ridge from the brush attaching portion 43.

Each scraping member 42 includes an elastic blade 46 that is provided with a scraper portion 45 having wavy cross section. The blade 46 is in the shape of a narrow, flat strip formed of flexible vinyl chloride or the like. The aforementioned scraper portion 45 is formed along one of the two lengthwise edges of the blade 46 by thickening both surfaces that sandwich said edge. A blade attaching portion 47 having a shape of a narrow, flat strip is formed along the other lengthwise edge of each blade 46 as an integral body with the blade 46. Each blade attaching portion 47 is formed of the same material as the blade 46 into a similar shape to the brush attaching portion 43 of each brush member 41.

The shaft insertion hole 39 of the brush base 35 houses a shaft 51 that serves as a rotary shaft. The shaft 51 is an axial member that is a hollow pipe formed of a material more rigid than that of the brush base 35; for example, the shaft 51 may be formed of a metal such as steel or stainless steel (SUS). The shaft 51 is inserted through the shaft insertion hole 39 of the brush base 35, with each axial end of the shaft protruding from the axial ends of the brush base 35.

Figure 4:
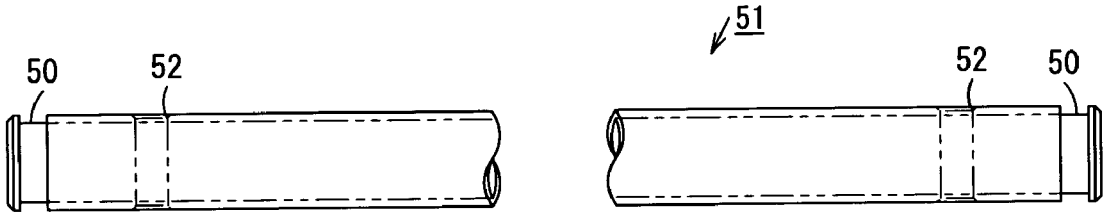
FIG. 4 is a partially omitted side view of an axial member of the aforementioned rotary cleaning body.
Figure 5:
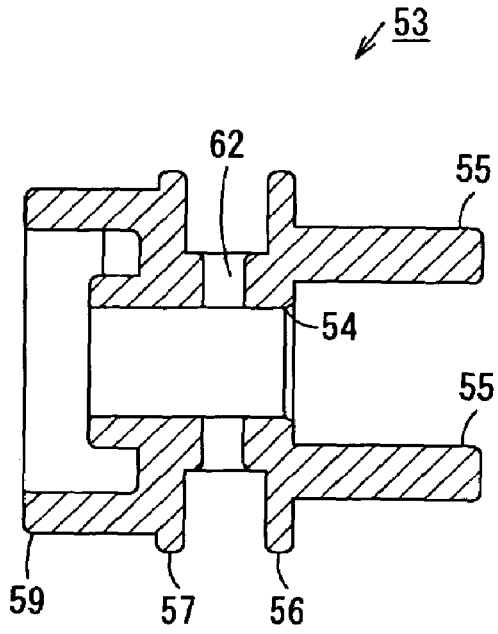
FIG. 5 is a vertical sectional view of a supporting member of the rotary cleaning body.
Figure 6:
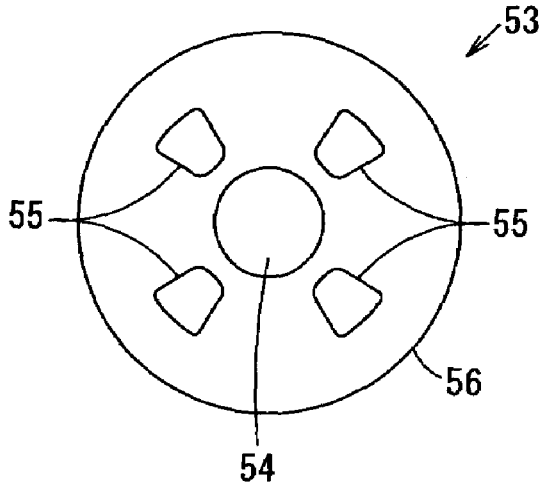
FIG. 6 is a side view of the aforementioned supporting member.

A pin insertion hole 52 is formed near each axial end of the shaft 51, passing through the shaft 51 radially. The two pin insertion holes 52 extend in parallel to each other and formed at such location that when the shaft 51 is inserted through the shaft insertion hole 39 of the brush base 35, both pin insertion holes 52 are exposed from the axial ends of the shaft base 35. As shown in FIG. 4, a fitting recess 50 that extends around the shaft 51 and has a recessed cross section is formed between each axial end of the shaft 51 and its adjacent pin insertion hole 52. The surface of each fitting recess 50 is burnished so as to reduce the resistance during rotation of the shaft.

As described above, the brush members 41 and the scraping members 42 are attached to the brush base 35 with the brush attaching portions 43 of the brush members 41 and the blade attaching portions 47 of the scraping members 42 snugly fitted in the catching grooves 34 of the brush base 35. As shown in FIGS. 1, 2, 5, and 6, substantially cylindrical receiving members 53 are coaxially attached to the two axial ends of the brush base 35, respectively. The receiving members 53 are receptacle elements that serve as supporting members for enabling the brush base 35 to be securely attached to the shaft 51 in such a state that the brush base 35 is circumferentially twisted in a spiral. The receiving members 53 are formed of a material more rigid than that of the brush base 35.

An insertion hole 54 for receiving an end of the shaft 51 is bored through the center of each receiving member 53. A plurality of stopper claws 55 (for example, four stopper claws 55), which serve as fitting protrusions, are formed on the distal end of each receiving member 53 at regular intervals around the peripheral edge of the insertion hole 54. These stopper claws 55 are adapted so that when the distal end of each receiving member 53 is fitted to the brush base 35, the stopper claws 55 of the receiving member 53 become fitted respectively in the stopper grooves 38 of the brush base 35, thereby securing the brush base 35 to the shaft 51 and preventing circumferential rotation of the brush base 35. When engaged in the stopper grooves 38 of the brush base 35, the stopper claws 55 permit the twisted brush base 35 to be secured to the shaft 51.

The stopper claws 55 of each receiving member 53 project in the axial direction, in the same direction the insertion hole 54 of the receiving member 53 opens. The stopper claws 55 have a cross section shaped to correspond to the stopper grooves 38 of the brush base 35. The stopper claws 55 also serve to determine, if it is necessary, an appropriate angle at which the brush base is to be twisted, and prevent circumferential displacement of the brush base 35, which is adapted to rotate circumferentially.

On the end of each receiving member 53 from which the stopper claws 55 are projected, a ring-shaped collar portion 56 is formed around the peripheral edge of the insertion hole 54 to extend circumferentially outward. The collar portion 56 of each receiving member 53 is formed so that, when the stopper claws 55 of the receiving member 53 are moved in the axial direction and fitted in the respective stopper grooves 38 at an end of the brush portion 35, thereby engaging the receiving member 53 to the end of the brush portion 35, the end face of the brush portion 35 abuts against the collar portion 56. Each collar portion 56 has an outer diameter slightly greater than the maximum outer diameter of the brush base 35 so as to prevent unintentional displacement of the brush members 41 or the scraping members 42 from the catching grooves 34.

On the other end of each receiving member 53, a ring-shaped collar portion 57 is formed around the peripheral edge of the insertion hole 54 to extend circumferentially outward. The collar portion 57 is coaxially provided with a cylindrical portion 59, which protrudes in the axial direction from the outer end surface of the collar portion 57. A bearing 58, which is in the shape of a substantially rectangular tube, is fitted in each cylindrical portion 59. The bearings 58 are adapted to be respectively fitted to the axial ends of the shaft 51 so that the shaft 51 is rotatably secured by the bearings 58. The cylindrical portions 59 of the receiving members 53 cover the outer side faces of the bearings 58 so as to prevent entry of dust or other foreign substances into the bearings 58.

A shaft supporting recess 61 is formed at each side of the air intake chamber 26 of the casing 21 of the floor brush 16 by dividing the air intake chamber 26. The bearings 58, which are fitted in the cylindrical portions 59 of the receiving members 53 and rotatably secure both ends of the shaft 51, are respectively fitted in the shaft supporting recesses 61. Thus, the shaft 51 are rotatably supported between the two shaft supporting recesses 61 by the bearings 58.

A pin insertion hole 62 is radially formed through each receiving member 53 at a location between the collar portion 56 and the collar portion 57. The pin insertion holes 62 are formed so as to respectively communicate with the pin insertion holes 52 of the shaft 51 when the two axial ends of the brush base 35 are circumferentially twisted in opposite directions by a given distance, thereby twisting the shaft 51 into a spiral. At that time, the shaft 51 is in such a state that it is inserted through the shaft insertion hole 39 of the brush base 35, with the two axial ends of the shaft 51 respectively inserted through the insertion holes 54 of the receiving members 53, and the stopper claws 55 of the receiving members 53 respectively fitted in the stopper grooves 38 of the brush base 35.

Then, each pin insertion hole 62 is aligned with the corresponding pin insertion hole 52 of the shaft 51. In this state, a pin 63 in the shape of a solid, slender cylinder is inserted through each aligned set of pin insertion holes 52, 62 so that the shaft 51 are fixed to the receiving members 53.

As the lateral ends of the brush attaching portions 43 of the brush members 41 and the lateral ends of the blade attaching portions 47 of the scraping members 42 are snugly in contact with the collar portions 56, which are formed on the distal ends of the receiving members 53, the brush members 41 and the scraping members 42 are securely supported to prevent detachment.

A motor 64 serving as a driving means is housed in the casing 21 of the floor brush 16, at a location behind the air intake chamber 26 and to one side of the casing 21 with respect to the air path chamber 28. A rotary shaft 65 protrudes from the distal end of the motor 64 and adapted to rotate as a result of rotation of the motor 64. A pulley 66 is concentrically attached to the rotary shaft 65. The pulley 66 is located behind one of the receiving members 53 of the rotary brush 33, which is installed in the air intake chamber 26 of the floor brush 16. The pulley 66 is adapted to rotate in the direction of rotation of the receiving member 53 located in front of the pulley 66.

An endless belt 67 serving as an adjusting belt is extended in a loop around the pulley 66 and the aforementioned receiving member 53 so as to link the pulley 66 and the receiving member 53. Therefore, when the motor 64 is driven, rotation of the rotary shaft 65 of the motor 64 rotates the pulley 66. As a result of rotation of the pulley 66, the belt 67 turns the aforementioned receiving member 53 of the rotary brush 33, thereby rotating the rotary brush 33.

Next, the procedure of assembling a rotary brush having a structure according to the embodiment described above is explained hereunder.

First, the brush base 35 is inserted through a jig shaft (not shown) and circumferentially twisted into a spiral. In this state, the brush base 35 is heated so as to increase the temperature by more than 30° C. and subsequently cooled so that the twisted state is maintained to a certain extent.

Thereafter, the brush attaching portions 43 of the brush members 41 and the blade attaching portions 47 of the scraping members 42 are securely fitted in the catching grooves 34 of the brush base 35 so that the brush members 41 and the scraping members 42 extend along the length of the brush base 35 and are alternately arranged in the circumferential direction.

Next, the shaft 51 is inserted through the shaft insertion hole 39 of the brush base 35. Thereafter, while the receiving members 53 are fitted to both ends of the shaft 51 so that the ends of the shaft 51 are inserted through the insertion holes 54 of the receiving members 53 respectively, the stopper claws 55 of the receiving member 53 are fitted from the axial ends of the brush base 35 into the stopper grooves 38 of the brush base 35.

In this state, the receiving members 53 at the two axial ends of the shaft 51 are circumferentially rotated in opposite directions, for example, 180° in relation to each other so that the brush base 35 is circumferentially twisted into a spiral until the pin insertion holes 62 of the receiving members 53 respectively communicate with the pin insertion holes 52 of the shaft 51.

Then, by inserting pins 63 through the pin insertion holes 62 of the receiving members 53 and the pin insertion holes 52 of the shaft 51, which communicate as described as above, the receiving members 53 are coupled to the shaft 51 so that the brush base 35 is maintained in a spirally twisted state.

Thereafter, in the state that each end of the shaft 51 projects outward from the insertion hole 54 of the receiving member 53, the bearings 58 are rotatably fitted in the fitting recesses 50 of the shaft 51. Thus, the rotary brush 33 is assembled.

Then, the bearings 58 of the rotary brush 33 are respectively fitted in the shaft supporting recesses 61 of the casing 21 so that the rotary brush 33 is rotatably secured in the air intake chamber 26 of the casing 21.

Next, how cleaning is performed by using the cleaner according to the embodiment described above is explained hereunder.

When cleaning is performed, first of all, the floor brush 16 is attached to the hose assembly 11 and the extension pipe 15, thereby connecting the floor brush 16 to the cleaner main body 1. Then, the hose assembly 11 is held by the handle portion 14 and pushed to move the floor brush 16 back and forth on the floor.

At that time, suction generated by driving the motor fan 2 in the cleaner main body 1 causes dirt on the floor to be suctioned into the suction opening 25 of the floor brush 16 together with the air.

In cases where a designated selection button 13 of the hand control unit 12 of hose assembly 11 is pushed to rotate the rotary brush 33 of the floor brush 16, rotation of the brush members 41 of the rotary brush 33 causes the bristles 44 of the brush members 41 to brush the floor. In cases where the floor surface is of a wooden flooring or the like, dirt adhering to the floor surface is brushed up off the floor and suctioned into the suction opening 25 of the floor brush 16.

Meanwhile, the scraping members 42 of the floor brush 33 rotates to wipe dirt off the floor surface. To be more specific, when the floor surface is of a carpet or the like, dirt embedded in the carpet is scraped up by the scraper portions 45 of the blades 46 of the scraping members 42 and suctioned into the suction opening 25 of the floor brush 16.

Thereafter, the dirt-laden air that has been suctioned in from the suction opening 25 of the floor brush 16 passes through the air intake chamber 26 and the air path chamber 28 and is then carried sequentially through the communicating pipe 29, the extension pipe 15, and the hose assembly 11 into the cleaner main body suction port 7 of the cleaner main body 1 from which the dirt is suctioned into the dust collection pack disposed in the cleaner main body 1 so that the dirt that has been suctioned together with the air is trapped in the dust collection pack.

As described above, according to the present embodiment, the brush members 41 and the scraping members 42 are alternately arranged, and, in this state, attached to the catching grooves 34, which are formed along the cylindrical outer surface of the brush base 35 so as to extend straight in the axial direction of the brush base 35; the shaft 51 is inserted through the shaft insertion hole 39 of the brush base 35; the receiving members 53 are respectively attached to the two axial ends of the shaft 51; and the stopper claws 55 of the receiving members 53 are fitted into the stopper grooves 38 of the brush base 35.

In this state, the receiving members 53, which are respectively at the two axial ends of the shaft 51, are rotated in opposite directions so that the brush base 35 extending therebetween is twisted into a spiral and enables the pin insertion holes 62 of the receiving members 53 respectively to communicate with the pin insertion holes 52 of the shaft 51. Then, by inserting pins 63 through the communicating pin insertion holes 52,62, the brush base 35 twisted in a spiral is attached to the shaft 51.

With the configuration as above, as there is no need of twisting the shaft 51, which serves as the axis of rotation and formed of metal and consequently heavy in weight, uneven rotation of the rotary brush 33 is prevented. Furthermore, as the shaft 51 can simply be inserted though the brush base 35, the production process is simplified.

At that time, before the shaft 51 is inserted through the shaft insertion hole 39 of the brush base 35, the brush base 35 may be circumferentially twisted into a spiral, and, in this state, heated so as to increase the temperature by more than 30° C. and subsequently cooled. This treatment enables the brush base 35 to remain in the twisted state to a certain extent, and, therefore, facilitate the operation of inserting the shaft 51 through the shaft insertion hole 39 of the brush base 35 and twisting the brush base 35. Thus, the rotary brush 33 an be produced more easily.

According to the present embodiment, when the brush base 35 provided with catching grooves 34, which extend straight, is attached to the shaft 51, the brush base 35 is maintained in a spiral state. The present embodiment thus enables the easy production of the brush base 35 with a simple method, without necessitating a complicated shaping process, such as twist extrusion molding.

When aligning the pin insertion hole 62 of each receiving member 53 with the corresponding pin insertion hole 52 of the shaft 51, the angle of rotation of each receiving member 53 can be adjusted by circumferentially shifting the position where the stopper claws 55 of the receiving member 53 become fitted in the stopper grooves 38 of the brush base 35. Therefore, as the degree of twisting, i.e. the angle of twisting, of the brush base 35 between the receiving members 53 can be adjusted easily, the brush base 35 according to the present embodiment can be used in a floor brush 16 of a wide variety of types. The embodiment thus expands the applicable range and also ensures that rolling balance can be attained easily when rotating the rotary brush 33.

The degree of twisting of the brush base 35 can be adjusted after the brush base 35 is inserted through the shaft 51. As this not only increases the yield of brush bases 35 but also ensures precision of twisting of the brush base 35 easily, it consequently ensures precision of production of the rotary brush 33, which incorporates this brush base 35.

By positioning the receiving members 53 attached to both axial ends of the brush base 35 so that the pin insertion holes 62 of the receiving members 53 respectively communicate with the pin insertion holes 52 of the shaft 51, and subsequently inserting pins 63 through these pin insertion holes 52, 62 so as to fix the receiving members 53 to the shaft 51, the brush base 35 can be fixed to the shaft 51 in such a state as to be twisted in a spiral. Therefore, the present embodiment has a simple configuration that enables the sure and easy fixture of the brush base 35 in a twisted state to the shaft 51.

Moreover, the embodiment described above uses receiving members 53 to hold the brush base 35 while preventing its displacement from the shaft 51, the brush base 35 is fixed to the shaft 51 in a spirally twisted state. In other words, by means of receiving members 53, the brush base 35 can easily be fixed to the shaft 51 in a twisted state while being prevented from slipping of the shaft 51. Therefore, the present embodiment improves the manufacturability of the rotary brush 33 by facilitating assembly of the rotary brush 33, which is principally comprised of the brush base 35, the shaft 51, and the receiving members 53.

A stopper groove 38 having a recessed cross section is formed between each catching groove 34 and its adjacent catching groove 34, each of which is adapted to securely receive therein the brush attaching portion 43 of a brush member 41 or the blade attaching portion 47 of a scraping member 42. Each receiving member 53 has a plurality of stopper claws 55 that are formed on the distal end of the receiving member 53 and adapted to be respectively fitted in the stopper grooves 38. This feature enables the catching grooves 34 to be formed in the brush base 35 so as to extend along the entire axial length.

As this enables the brush attaching portions 43 and the blade attaching portions 47 to be attached to the brush base 35, along the entire length of the brush base 35, the rotary brush 33, which is principally comprised of the brush base 35, the shaft 51, and the receiving members 53, is capable of floor brushing or scraping dust off a wide area of the floor with a single sweep. Therefore, the floor brush 16 is made more convenient to use.

As the axes of the pin insertion holes 52, which are located at the two axial end portions of the shaft 51, extend in parallel to each other in the radial direction of the shaft 51, the pin insertion holes 52 can be simultaneously formed through the shaft 51. In this way, the production of the shaft 51 is facilitated.

The brush base 35 has a simple structure, with catching grooves 34 simply formed in the cylindrical outer surface of the brush base 35. Therefore, unlike a brush base that is integrally provided with scraping members and other similar components on the cylindrical outer surface thereof, the brush base 35 according to the embodiment permit various components, such as the brush members 41, the scraping member 42, or floor scrubbing members provided with cloth blades (not shown). By thus enabling cleaning members that are suitable for the use of the vacuum cleaner incorporating this brush base 35 to be attached to the catching grooves 34 of the brush base 35, the embodiment described above expands the range of usage of the brush base 35.

According to the embodiment described above, the catching grooves 34 for engaging the brush members 41 and the scraping member 42 are formed straight in the brush base 35, and by twisting and attaching the brush base 35 in the twisted state to the shaft 51, the catching grooves 34 are shaped into a spiral. However, the brush base 35 may be formed in a twisted shape from the beginning and then attached to the shaft 51.

The brush base 35 may be twisted by an alternative method that calls for securing the center portion of the brush base 35 to the shaft 51 and rotating the receiving members 53, which are respectively fitted to the two axial ends of the brush base 35, in the same direction, thereby twisting the brush base 35 into a V-shaped spiral so that the brush base 35 is provided with a plurality of spiral portions. A brush base 35 formed in this manner, too, can be used with the shaft 51 by fixing to the shaft 51 the receiving members 53 that are fitted to the two axial ends of the brush base 35.

When twisting the brush base 35 by the aforementioned alternative method, the receiving members 53 fitted to the axial ends of the brush base 35 may be rotated in the opposite directions with the center portion of the brush base 35 fixed to the shaft 51. As a result, the brush base 35 is fixed to the shaft 51, with the degree of twisting at one axial end of the brush base 35 being different from that at the other axial end of the brush base 35.

The invention is applicable to not only canister type vacuum cleaners but also those of other types, such as, for example, an upright type cleaner provided with a floor brush 16 that is formed directly under the cleaner main body 1, or a vacuum cleaner having integrated cleaner main body 1 and floor brush 16, such as those of a self-propelled type or hand-held type.

The floor brush 16 may be provided with a plurality of rotary brushes 33. Furthermore, instead of rotating the rotary brush 33 by the motor 64 as in the case of the embodiment described above, it is also permissible to rotate the rotary brush 33 by using the air suctioned in by the motor fan 2.

Figure 8:
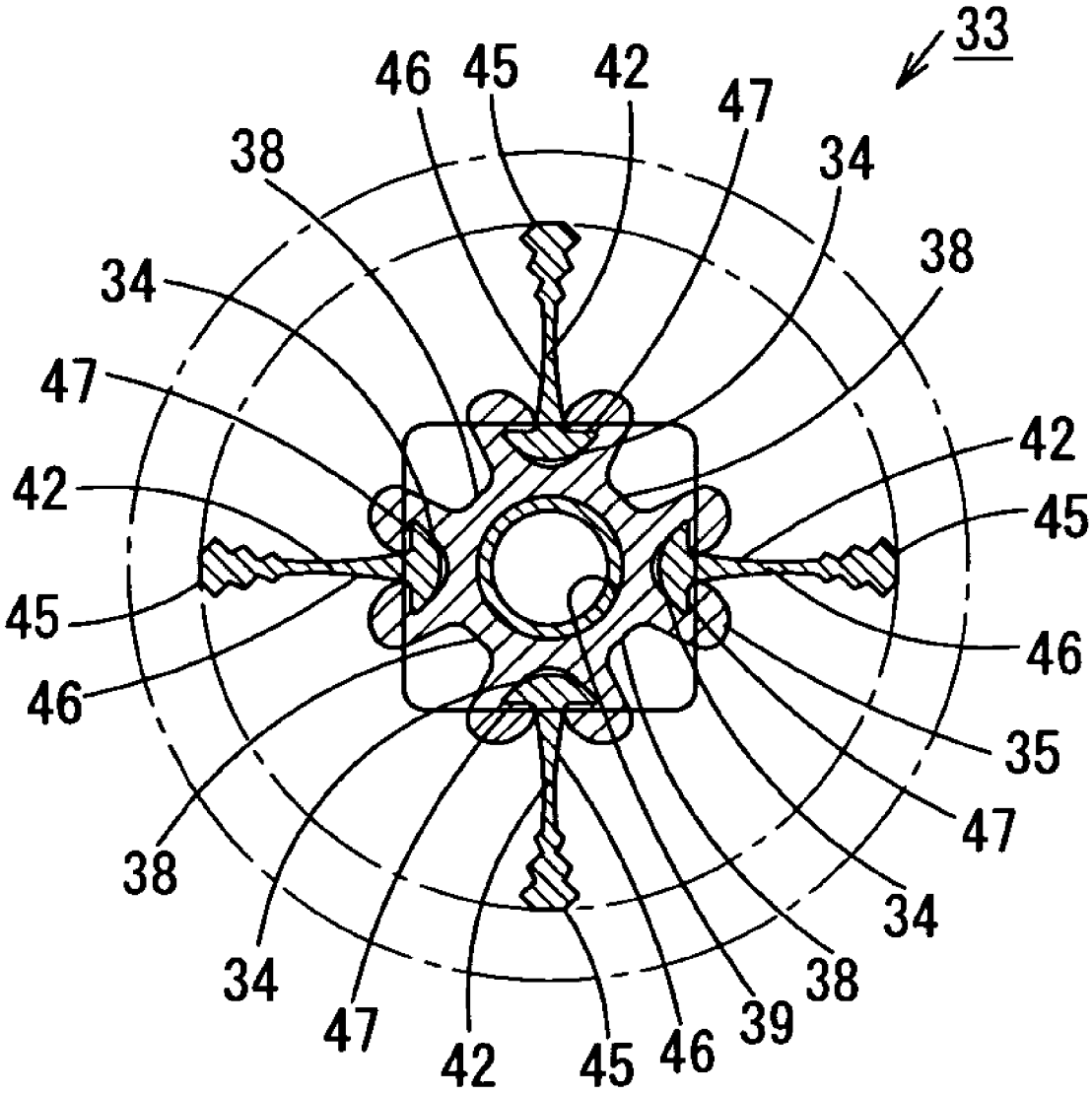
FIG. 8 is a vertical sectional view of a rotary cleaning body according to another embodiment of the present invention.

Although the brush base 35 is provided with four catching grooves 34 according to the embodiment described above, the number of catching grooves 34 are deemed sufficient should there be at least one catching groove 34, provided that the number of catching grooves 34 corresponds to the number of cleaning members to be attached to the brush base 35. The cleaning members are not limited to brush members 41 or scraping members 42; for example, floor scrubbing members provided with cloth blades or the like may also be used. Although the brush members 41 and the scraping members 42 are alternately attached to the catching grooves 34 of the brush base 35 according to the embodiments described above, the arrangement of the cleaning members is not limited to the arrangement comprised of alternating members; it is also permissible to attach a single kind (as shown in FIG. 8) or various kinds of scraping members 42.

After the rotary brushes 33 is assembled by fitting the brush members 41 and the scraping members 42 or other equivalent components in the catching grooves 34 of the brush base 35, inserting the shaft 51 through the shaft insertion hole of the brush base 35, twisting the brush base 35, and fixing the twisted brush base 35 to the shaft 51 by using the receiving members 53, the entire rotary brushes 33 may be heated so that the brush base 35 remains in the twisted state. During this process, however, the heating of the rotary brush 33 has to be performed at such a temperature as not to have an unfavorable influence on the brush members 41, the scraping members 42, or other components.

INDUSTRIAL APPLICABILITY

As described above, a rotary cleaning body, a suction port body of a vacuum cleaner, and the method of producing a rotary cleaning body according to the invention may be used for, for example, a vacuum cleaner or the like.

The invention claimed is:

1. A rotary cleaning body comprising:

a cylindrical mounting meter which is formed of a deformable material and has a cylindrical outer surface, and which comprises: (i) a plurality of recessed receiving grooves in the outer cylindrical surface that are spaced apart circumferentially around the mounting meter and that extend axially along the mounting meter, and (ii) a plurality of recessed stopper grooves that are formed in the outer cylindrical surface of the mounting member between adjacent ones of the receiving grooves;

a plurality of cleaning members, each of which has a base end secured in a corresponding one of the receiving grooves to be attached to the mounting member so as to extend along the axial direction of the mounting meter and protrude outward in a radial direction of the mounting meter;

an axial member inserted through a center of said mounting member;

a plurality of supporting meters which prevent unintentional displacement of the cleaning meters at axial ends of the receiving grooves, and each of which comprises a plurality of fitting protrusions that are insertable into the stopper grooves, respectively, so as to secure the mounting member to the axial member; and wherein when the supporting members are coupled to the axial member, the coupling of the supporting members to the mounting member via the fitting protrusions and stopper grooves causes the mounting member to be spirally twisted such that the receiving grooves are shaped into spirals, and the mounting member is supported in the twisted state due to the coupling of the supporting members to the mounting member via the fitting protrusions and stopper grooves.

2. A suction port body for a vacuum cleaner comprising:

(i) a casing including a suction port open to the outside; and (ii) a rotary cleaning body which is rotatably attachable to the casing so that the rotary cleaning body faces a surface to be cleaned, wherein the rotary cleaning body comprises:

a cylindrical mounting member which is formed of a deformable material and has a cylindrical outer surface, and which comprises: (i) a plurality of recessed receiving grooves in the outer cylindrical surface that are spaced apart circumferentially around the mounting member and that extend axially along the mounting member, and (ii) a plurality of recessed stopper grooves that are formed in the outer cylindrical surface of the mounting member between adjacent ones of the receiving grooves;

a plurality of cleaning members, each of which has a base end secured in a corresponding one of the receiving grooves to be attached to the mounting member so as to extend along the axial direction of the mounting member and protrude outward in a radial direction of the mounting member;

an axial member inserted through a center of said mounting member; and a plurality of supporting members which prevent unintentional displacement of the cleaning members at axial ends of the receiving grooves, and each of which comprises a plurality of fitting protrusions that are insertable into the stopper grooves, respectively, so as to secure the mounting member to the axial member;

wherein when the supporting members are coupled to the axial member, the coupling of the supporting members to the mounting member via the fitting protrusions and stopper grooves causes the mounting member to be spirally twisted such that the receiving grooves are shaped into spirals, and the mounting member is supported in the twisted state due to the coupling of the supporting members to the mounting member via the fitting protrusions and stopper grooves.

3. A method of producing a rotary cleaning body, comprising:

securing base ends of a plurality of cleaning members in respective recessed receiving grooves so as to extend along an axial direction of a deformable mounting member and to protrude outward in a radial direction of the mounting member, wherein the recessed receiving grooves are formed in an outer cylindrical cuter surface of the mounting member and are spaced apart circumferentially around the mounting member and extend axially along the mounting member, and the mounting member includes a plurality of recessed stopper grooves that are formed in the outer cylindrical surface between adjacent ones of the receiving grooves;

inserting an axial member through the center of said mounting member;

coupling a supporting member to each axial end of the mounting member, such that fitting protrusions of the supporting member are inserted into the stopper grooves, respectively, of the mounting member, so as to secure the mounting member to the axial member and to prevent unintentional displacement of the cleaning members at axial ends of the receiving grooves;

coupling the supporting members to the axial member such that, due to the coupling of the supporting members to the mounting member via the fitting protrusions and stopper groves, the mounting member is spirally twisted such that the receiving grooves are shaped into spirals, and such that the mounting member is supported in the twisted state.

4. The method as claimed in claim 3, further comprising heating the mounting member while the mounting member is twisted.

* * * * *